United States Patent [19]

Wiehagen

[11] Patent Number: 4,926,780

[45] Date of Patent: May 22, 1990

[54] SEA ANCHOR DEPLOYMENT AND STORAGE DEVICE AND ASSOCIATED METHOD

[76] Inventor: Fred A. Wiehagen, 103 D. Harper Dr., Turtle Creek, Pa. 15145

[21] Appl. No.: 298,575

[22] Filed: Jan. 18, 1989

[51] Int. Cl.[5] ..... B63B 21/48

[52] U.S. Cl. ..... 114/311; 114/293

[58] Field of Search ..... 114/293, 310, 311, 294; 124/5; 441/85

[56] References Cited

U.S. PATENT DOCUMENTS

| | | | |
|---|---|---|---|
| 3,083,675 | 4/1963 | Rice | 114/294 |
| 3,591,180 | 7/1971 | Lafon | 124/5 |
| 3,794,323 | 2/1974 | Johnson | 124/5 |
| 4,004,625 | 1/1977 | Zietlow, Jr. | 114/294 X |
| 4,330,895 | 5/1982 | Putman et al. | 114/311 |
| 4,632,051 | 12/1986 | Raymond et al. | 114/311 |

*Primary Examiner*—Sherman D. Basinger
*Assistant Examiner*—Edwin L. Swinehart
*Attorney, Agent, or Firm*—Arnold B. Silverman; David V. Radack

[57] ABSTRACT

A sea anchor and apparatus for deploying the sea anchor into water and for storing it when not in use. An associated method provides for the deployment of the sea anchor into water and storing the sea anchor after use.

12 Claims, 2 Drawing Sheets

SEA ANCHOR DEPLOYMENT AND STORAGE DEVICE AND ASSOCIATED METHOD

BACKGROUND OF THE INVENTION

1. Field of the Invention:

This invention relates to sea anchors which stabilize boats floating in water and, more particularly, to a unique apparatus for the deployment and storage of such sea anchors.

2. Description of the Prior Art

Sea anchors are used to control the motion of boats and are well known in the art. See, for example, United States Letters Patent No. 4,632,051 the contents of which are hereby incorporated by reference. The sea anchor is a parachute type device which expands to assume a somewhat mushroom shape when deployed in the water. The sea anchor is attached to the boat by an elongated rope which is tied to any secure member in the stern of the boat.

As the boat moves through the water it pulls the rope and sea anchor behind it. Such movement causes some of the water to become entrapped within the mushroom shaped interior of the sea anchor. The water, in turn, exerts a force on the interior surface of the sea anchor in a direction opposite that which the boat and attached sea anchor are moving. This force, in turn, is applied throuqh the rope to the boat thereby slowing its motion through the water.

The sea anchor, frequently, has one or more openings formed in its surface to allow some water flow therethrough. The size of such openings is determined by the desired speed which the boat is to travel through the water since a larger opening will allow the boat to move faster than a smaller opening. The sea anchor is pulled out of the water and placed in the interior of the boat when it is no longer desired that the boat be slowed.

A major problem exists with respect to the removal of the sea anchor from the water. When the sea anchor is deployed in the water, a force, large enough to oppose the motion of the boat, is imposed on interior surface of the the sea anchor and the rope which connects the sea anchor to the boat. That force must be overcome when drawing the rope and the sea anchor toward the boat. This problem is especially significant if manual force must be employed to draw in the sea anchor.

A second major problem exists once the sea anchor is drawn into the boat. Excess water clinging to the sea anchor will drain onto the floor of the boat creating a slipping hazard Further the bulky sea anchor itself will create a tripping or slipping hazard if placed on the floor of the boat. The present invention overcomes all of these problems.

SUMMARY OF THE INVENTION

The present invention provides apparatus for the deployment and storage of a sea anchor which includes a body member defining an exterior surface and an interior compartment for storing the sea anchor with the body member having a first end and a second end with the first end adapted to be held by a person and the second end defining an opening in the exterior surface for access to the interior compartment with the second end adapted to deploy the sea anchor when the body member is impelled by the person and adapted to receive the sea anchor for storage within the interior compartment.

Also provided is apparatus for controlling the motion of a floatable object which includes anchor apparatus and attachment apparatus connected to the anchor apparatus for attaching the anchor apparatus to the floatable object. Also included is deployment and storage apparatus for deploying and storing the anchor apparatus and the attachment apparatus which includes a body member defining an exterior surface and an interior compartment for storing the anchor apparatus within the body member having a first end and a second end with the first end adapted to be held by a person and the second end defining an opening in the exterior surface for access to the interior compartment. The second end is adapted to deploy the anchor apparatus and the attachment apparatus when the body member is impelled by the person and adapted to receive the anchor apparatus and the attachment apparatus for storage within the interior compartment.

Further provided is a method for controlling the motion of a floatable object which includes the steps of providing anchor apparatus, providing attachment apparatus connected to the anchor apparatus for attaching the anchor apparatus to the floatable object, and providing deployment and storage apparatus for deploying and storing the anchor apparatus and the attachment apparatus and deploying the anchor apparatus and the attachment apparatus by impelling the deployment and storage apparatus and attaching the anchor apparatus to the floatable object with the attachment apparatus. The deployment and storage apparatus includes a body member defining an exterior surface and an interior compartment for storing the anchor apparatus and the attachment apparatus with the body member having a first end and a second end with the first end adapted to be held by a person and the second end defining an opening in the exterior surface for access to the interior compartment. The second end is adapted to deploy the anchor apparatus and the attachment apparatus when the body member is impelled by the person and adapted to receive the anchor apparatus and the attachment apparatus for storage within the interior compartment.

BRIEF DESCRIPTION OF THE DRAWINGS

The following description of the preferred embodiment of the present invention may be better understood and further uses and advantages thereof made more apparent if reference is made to the accompanying drawings in which.

DETAILED DESCRIPTION OF THE PREFERRED EMBODIMENT

Figure 1:
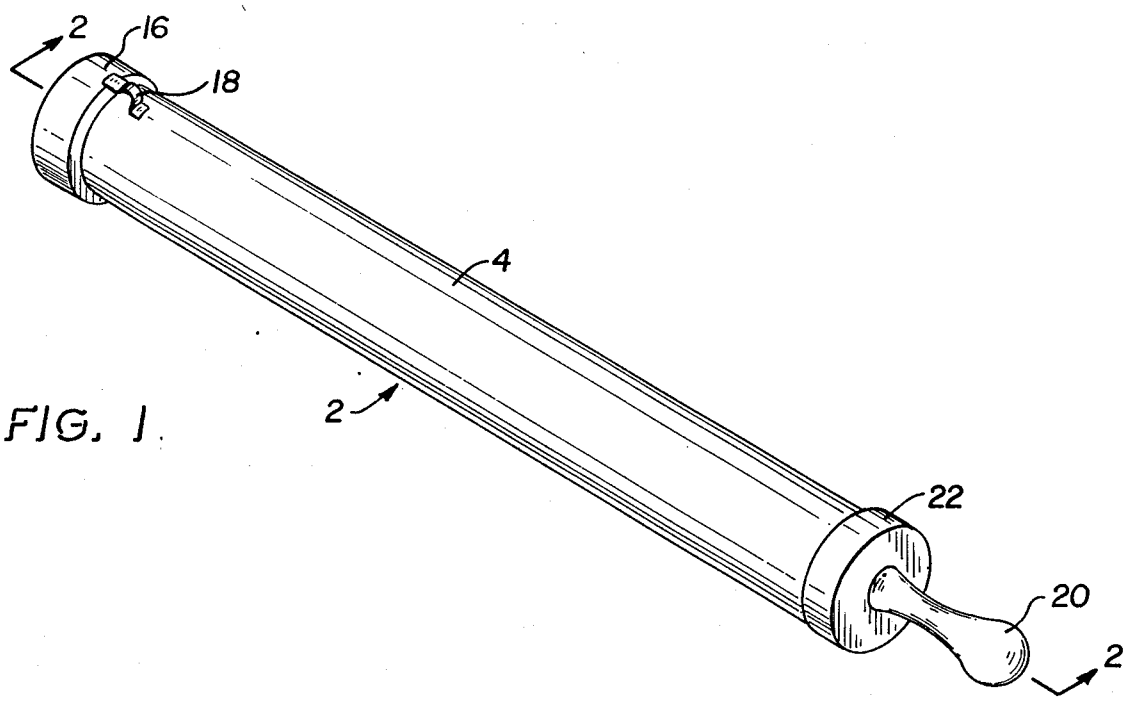
FIG. 1 is a perspective view of the present invention.

FIGS. 1 through 5 show the preferred embodiment of the present invention. Sea anchor system 2 includes elongated tube 4, sea anchor 6 and rope 8. Rope 8 is attached to sea anchor 6 through a plurality of eyelets 10.

Rope 8 comprises a plurality of strands of string or cord which are wound together to form a single section of rope from spool 12 to point 14. At point 14, the individual strands of string or cord separate so that each one may be tied to an individual eyelet 10. Tube 4 includes end cap 16 which is attached to tube 4 by hinge 18. Tube 4 also includes carrying handle 20 which is attached to end cap 22 and spool 12. Sea anchor 6 defines opening 24 which permits the passage of water therethrough when sea anchor 6 is deployed in the water.

Figure 2:
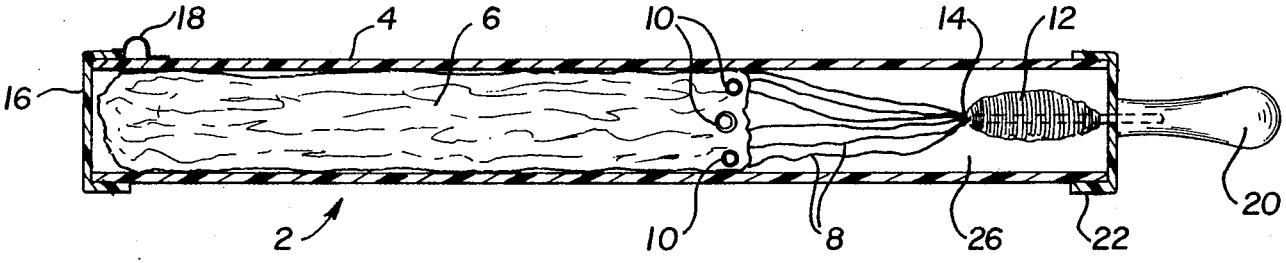
FIG. 2 is a side elevational sectional view taken along line 2—2 in FIG. 1.

In use, sea anchor 6 is initially positioned within tube 4 and with end caps 16 and 22 positioned as shown in FIGS. 1 and 2. In this manner, the sea anchor may be conveniently and compactly stored inside a boat, and in a location which minimizes tripping and slipping hazards, when not deployed.

Figure 3:
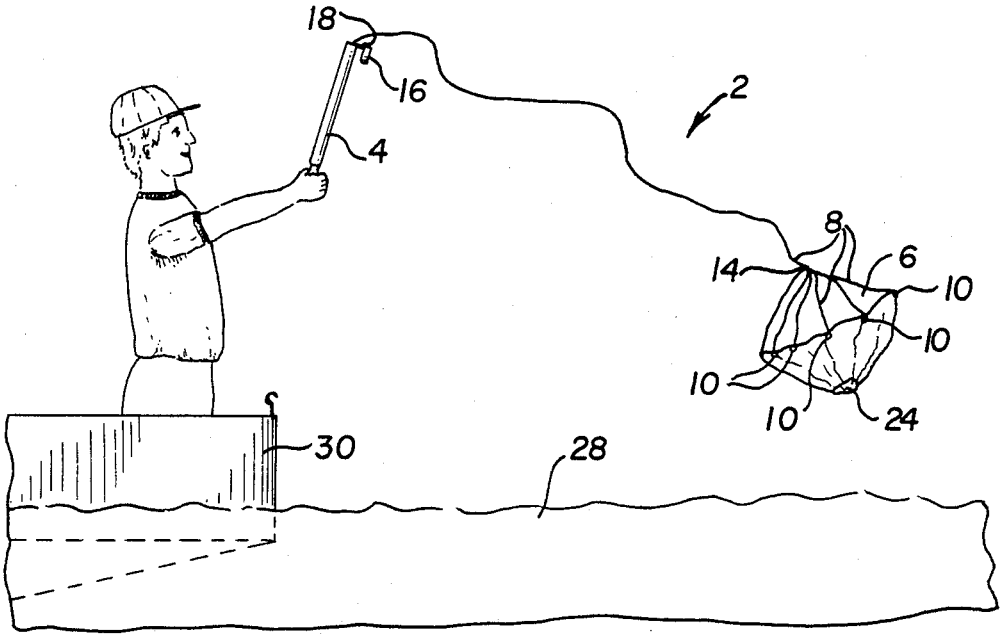
FIG. 3 is a side elevational view of a person deploying the sea anchor of FIG. 1 in water.

When the sea anchor is to be deployed into water 28, end cap 16 is pivoted about hinge 18 to the position shown in FIG. 3. End cap 22 is then removed from tube 4 and several feet of rope are unraveled from spool 12. The unraveled rope is then positioned within interior 26, of tube 4, and end cap 22 is then replaced on tube 4. Tube 4 is then held as shown FIG. 3 near end cap 22.

Tube 4 is then swung, or impelled forward in a manner similar to the swinging of a fishing rod when the fishing line is to be cast into the water. The swinging motion causes sea anchor 6, and the portion of rope 8 which has been unraveled from spool 12; to be discharged from tube 4, as shown in FIG. 3 and into the water 28. Rope 8 is then tied to the stern of boat 30 and tube 4 is placed on the bottom of boat 30 as shown in FIG. 4.

Figure 4:
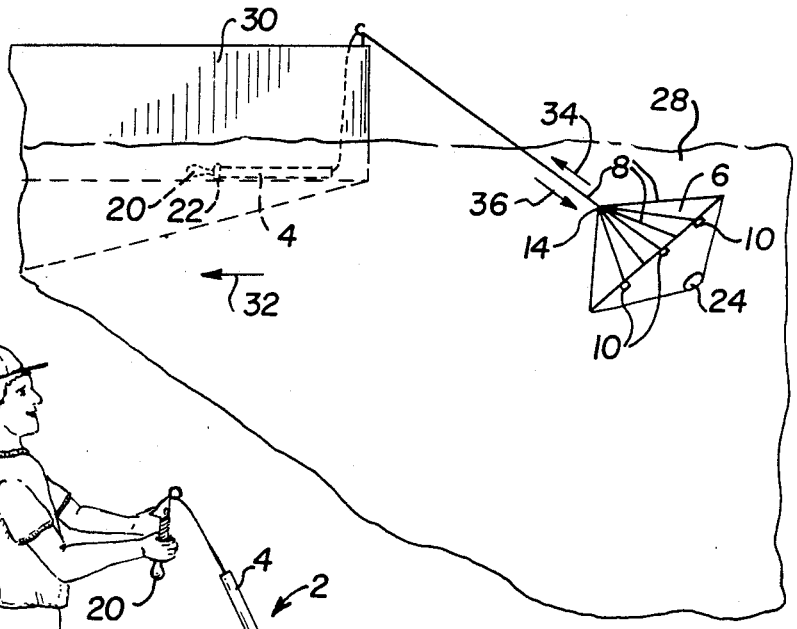
FIG. 4 is a side elevational view of the sea anchor of FIG. 1 attached to a boat.

As the boat moves through water 28 in the direction of arrow 32, sea anchor 6 is pulled in the direction of arrow 34 by rope 8 and assumes its mushroom shape, as shown in FIG. 4, due to the relative motion between sea anchor 6 and water 28. Water 28 applies a force, to sea anchor 6, and the direction of arrow 36 which, in turn, applies a force to boat 30 which opposes the motion of the boat.

Some of water 20 passes through opening 24 of sea anchor 6 thereby allowing less force to be applied to oppose the motion of boat 30 than if no opening, or a smaller opening, were provided. This allows boat 30 to move at a faster speed, in the direction of arrow 32. than if no opening or a smaller opening were provided The speed of boat 30 may thereby be controlled through the relative sizing of opening 24 and the interior surface area of sea anchor 6.

In addition to controlling the speed of boat 30, when sea anchor 6 is deployed as shown in FIG. 4, the force applied by rope 8, in the direction of arrow 36, to the stern of boat 30 keeps the longitudinal axis of boat 30 turned parallel to the direction of wave motion of water 28. Should the longitudinal axis of boat 30 turn perpendicular to the the wave motion of water 28, then the possibility exists that boat 30 might capsize by the waves which hit boat 30 broadside. This possibility is minimized if the longitudinal axis of boat 30 is turned parallel to the wave motion. Such parallel positioning of boat 30 with respect to the wave motion will always be accomplished if sea anchor 6 is deployed as shown in FIG. 4.

Figure 5:
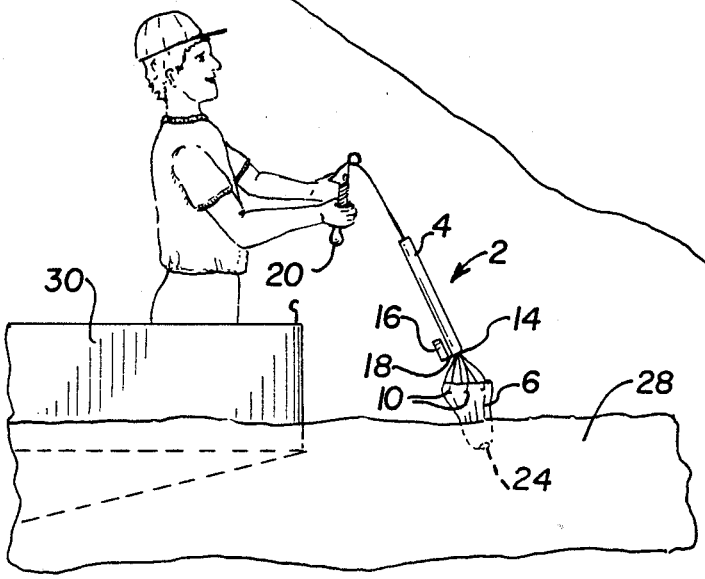
FIG. 5 is a side elevational view of a person drawing in the sea anchor of FIG. 1 from the water.

When the deployment of sea anchor 6 is no longer desired rope 8 is disengaged from the stern of boat 30 and carrying handle 20 and end cap 22 along with spool 12, are removed from tube 4. Tube 4 is then tossed in the water thereby allowing it to slide along rope 8 until it reaches point 14. When tube 4 reaches point 14, the individual cords of rope 8 are drawn together as they enter the narrow opening of tube 4. This forces sea anchor 6 to collapse as shown in FIG. 5.

When sea anchor is collapsed out of its mushroom shaped configuration, the force applied by water 28 on the interior surface of sea anchor 6 is greatly reduced since much of the interior surface area of sea anchor 6 is then parallel to the direction of travel of boat 30 and, therefore, cannot apply a force to rope which opposes the motion of boat 30. Manual rewinding of rope 8 onto spool 12 is, therefore, easily accomplished to remove sea anchor 6 from water 28. As sea anchor 6 is drawn within the interior of tube 4, excess water clinging to sea anchor 6 is squeezed out and back into water 28 and not onto the floor of boat 30. End cap 16 and 22 are then replaced on tube 4 and the entire device may then be conveniently stored.

It may be appreciated, therefore, that the apparatus of the present invention provides a convenient method for both deploying and storing a sea anchor which eliminates the inherent problems presented by the prior art as described above.

Whereas particular embodiments of the invention have been described for purposes of illustration, it will be evident to those skilled in the art that numerous variations of the details may be made without departing from the invention as defined in the appended claims.

What is claimed is:

1. A sea anchor deployment and storage apparatus comprising:

anchor means;

attachment means having a first end and a second end, said anchor means connected to said first end;

spool means connected to said second end of said attachment means, said spool means adapted to store, pay out and retrieve said attachment means; and elongated tube means having a first end and a second end and defining an interior compartment for storing said anchor means, said spool means being removably attached to said first end of said elongated tube means and said anchor means being deployed from said second end of said elongated tube means.

2. The apparatus of claim 1, wherein said anchor means is deployed by paying out said attachment means from said spool means and said anchor means is retrieved by allowing said elongated tube means to slide on said attachment means towards said anchor means so that said anchor means becomes partially collapsed and then rewinding said attachment means onto said spool means.

3. The apparatus of claim 2, wherein said attachment means is rope means.

4. The apparatus of claim 3, wherein said rope means extends between said anchor means and said spool means.

5. The apparatus of claim 4, wherein a portion of said rope means is positioned within said interior compartment.

6. The apparatus of claim 5, wherein said second end includes removable cap means.

7. The apparatus of claim 6, wherein said anchor means is a sea anchor.

8. A method for controlling the motion of a floatable object comprising the steps of:

providing a sea anchor deployment and storage apparatus including (i) anchor means, (ii) attachment means having a first end and a second end, said anchor means connected to said first end, (iii) spool means connected to said second end of said attachment means, said spool means adapted to store, pay out and retrieve said attachment means and (iv) elongated tube means having a first end and a second end and defining an interior compartment for storing said anchor means, said spool means being removably attached to said first end of said elongated tube means and said anchor means being deployed from said second end of said elongated tube means;

deploying said anchor means and said attachment means by impelling said spool means and said elongated tube means so that said attachment means is paid out from said spool means; and attaching said anchor means to said floatable object with said attachment means.

9. The method of claim 8, further comprising the steps of retrieving said anchor means by causing said elongated tube means to slide on said attachment means so that said anchor means becomes partially collapsed; and rewinding said attachment means onto said spool means.

10. The method of claim 9, further comprising the steps of wringing out excess water from said anchor means said anchor means is pulled out into said second end of said elongated tube means.

11. The method of claim 10, further comprising the step of storing said anchor means and said attachment means in said interior compartment.

12. The method of claim 11, further comprising the steps of providing removable cap means for covering said second end of said elongated tube means and covering said second end of said elongated tube means with said removable cap means.

* * * * *

UNITED STATES PATENT AND TRADEMARK OFFICE

CERTIFICATE OF CORRECTION

PATENT NO. : 4,926,780

DATED : May 22, 1990

INVENTOR(S) : FRED A. WIEHAGEN

It is certified that error appears in the above-identified patent and that said Letters Patent is hereby corrected as shown below:

Col. 1, line 53, a period --.-- should be inserted after "hazard".

Col. 3, line 38, "and" should be --in--.

Col. 3, line 41, "water 20" should be --water 28--.

Col. 3, line 45, "32." should be --32,--.

Col. 3, line 46, a period --.-- should be inserted after "provided".

Col. 3, line 65, a comma --,-- should be inserted after "desired".

Claim 10, col. 6, line 12, --when-- should be inserted before "said anchor means".

Signed and Sealed this

Twelfth Day of May, 1992

*Attest:*

*Attesting Officer*

DOUGLAS B. COMER

*Acting Commissioner of Patents and Trademarks*